United States Patent [19]

Cassoli

[11] Patent Number: 4,679,379

[45] Date of Patent: Jul. 14, 1987

[54] AUTOMATIC BUNDLING MACHINE

[75] Inventor: Paolo Cassoli, Casalecchio Di Reno, Italy

[73] Assignee: Cassoli s.r.l. Macchine Automatiche Confezionatrici, Bologna, Italy

[21] Appl. No.: 531,740

[22] Filed: Sep. 13, 1983

[51] Int. Cl.[4] ..... B65B 63/02

[52] U.S. Cl. ..... 53/438; 53/447; 53/450; 53/530; 53/540; 53/550; 100/232; 414/46; 414/96

[58] Field of Search ..... 53/150, 438, 447, 450, 53/459, 529, 537–539, 540, 548, 550, 555, 575, 577, 578, 551, 439, 530; 414/46, 96; 100/232, 42

[56] References Cited

U.S. PATENT DOCUMENTS

| | | | |
|---|---|---|---|
| 2,747,346 | 5/1956 | Tigerman et al. | 53/550 X |
| 2,969,629 | 1/1961 | Blais | 53/529 |
| 3,303,630 | 2/1967 | Harm | 53/450 X |
| 3,384,007 | 5/1968 | Boje et al. | 53/530 X |
| 3,517,482 | 6/1970 | Beninger | 414/96 X |
| 3,608,269 | 9/1971 | Gore | 53/529 X |
| 3,660,961 | 5/1972 | Ganz . | |
| 3,794,154 | 2/1974 | Holt . | |
| 3,807,128 | 4/1974 | Bauer . | |
| 3,811,242 | 5/1974 | Hayford et al. | 100/232 X |
| 3,870,166 | 3/1975 | Tull III | 414/46 |
| 3,876,057 | 4/1975 | Jones | 53/447 X |
| 3,877,562 | 4/1975 | Shaw . | |
| 4,018,031 | 4/1977 | Smaw . | |
| 4,033,862 | 7/1977 | Spencer . | |
| 4,054,019 | 10/1977 | Weichhand et al. | 100/232 X |
| 4,062,169 | 12/1977 | Lister et al. | 53/439 |
| 4,117,647 | 10/1978 | Rossi | 53/551 X |
| 4,141,193 | 2/1979 | Joa | 53/529 |
| 4,144,697 | 3/1979 | Suga . | |
| 4,430,844 | 2/1984 | James | 53/450 |
| 4,506,488 | 3/1984 | Matt et al. . | |

FOREIGN PATENT DOCUMENTS

| | | | |
|---|---|---|---|
| 1464245 | 2/1977 | United Kingdom | 53/538 |

OTHER PUBLICATIONS

Cassoli Brochure for Automatic Wrapping Machine (date unknown).

*Primary Examiner*—Robert L. Spruill
*Assistant Examiner*—Steven P. Weihrouch
*Attorney, Agent, or Firm*—Hill, Van Santen, Steadman & Simpson

[57] ABSTRACT

A fully automatic bundling machine forms a bundle of stacked compressed rows of rolled tissue product and wraps the bundle with thermoweldable material which is taken from a single roll. For larger rolled products such as household paper towels, the individual product rolls are not upended at any point during bundling, but always remain horizontal. The single roll of thermoweldable material is bundled around a selected number of stacked rows of product after compression thereof, so as to form a tunnel which is open at one end. The compressed product rolls are inserted into the tunnel and the wrapped bundle is advanced to a welding and cutting station which simultaneously closes the open end of the bundle and cuts the thermoweldable material along the weld line such that the wrapped bundle is completely sealed and one end of the thermoweldable wrapping for the next bundle is closed. The bundling station is adjustable in height and width for selectively dimensioning the folding imparted to the thermoweldable material for accomodating different sizes of bundles.

18 Claims, 19 Drawing Figures

40a
40
40b
45
44
43
46
45
43
44
47
40c
40d
50
48
50
49
20
33
35
32
15
19
18
13
40
39
17
13
32
33
20
14
35

81a
54
82a
51
73
53
83
83
52
83
51
74
55

52
82b
54

69
18
65
57
55
53
81b
58
56
59
84
65

AUTOMATIC BUNDLING MACHINE

BACKGROUND OF THE INVENTION

The present invention relates to automatic bundling machines, and in particular to such bundling machines for wrapping rolled tissue products in compressed stacked rows with thermoweldable material.

Devices and systems for wrapping articles in thermoplastic and/or thermoweldable stretchable film material are known in the art. Such an apparatus is generally disclosed, for example, U.S. Pat. No. 4,144,697 wherein articles to be wrapped are moved through a tunnel of stretchable film material which enclosing the articles in a tube of film which is subsequently cut before and after the enclosed article and folded and sealed. Another approach for rolled products such as toilet tissue, paper towels and other paper products inserts a selected number of the products into a preformed plastic bag, which is subsequently sealed at its opened end after the articles are inserted therein. A similar device for individually wrapping the rolls in plastic material is described in U.S. Pat. No. 4,018,031 which also makes use of preformed bags. Another approach for wrapping such articles in groups has been to convey the articles through a wrapping machine which surround the groups of articles with a sheet or web of wrapping material and subsequently seals the material around the articles. Such devices are described, for example, U.S. Pat. Nos. 3,660,961; 3,794,154; and 3,807,128.

In handling wound rolls of larger sizes, such as rolls of paper towels, it is a problem in the art to convey such rolls for bundling in a rapid manenr which does not cause clogging or misalignment of the rolls. This problem is partilarly acute when the rolls must be upended, that is placed so that the inner cardboard tube or roll is vertical, during the bundling procedure. Because of the weight of such larger rolls, the base of the rolls resting on the surface along which the rolls are to be conveyed causes excessive friction with the base, thereby resisting easy movement of the rolls in this position. Various devices such as that disclosed in U.S. Pat. No. 4,033,862 have been heretofore utilized to avoid conveying the rolls in this position by pushing the rolls, resorting to complicated gripper mechanisms for grabbing the rolls individually.

SUMMARY OF THE INVENTION

It is an object of the present invention to provide bundling apparatus for compressing and bundling stacked rows of rolled paper product, such as paper towels without upending the product during the wrapping process.

It is a further object of the present invention to provide a bundling apparatus for bundling such stacked compressed rows utilizing a single sheet of thermoweldable material which is folded around the bundle to be wrapped in a manner such that the material is closed at one end and has an open end for receiving the rows to be bundled.

It is a further object of the present invention to provide such a bundling apparatus which can be adjusted to bundle rolls of different sizes without the necessity of interchanging parts to accomodate the different sizes.

It is another object of the present invention to provide such a bundling apparatus which can be adpated to wrap rolls of smaller tissue product, such as bathroom tissue rolls, or use in combination with a device which does upend the smaller rolls but which retains all of the aforementioned advantages.

The above objects are inventively achieved in a fully automatic bundling apparatus which forms a sack of thermoweldable material, such as polyethylene, which is automatically filled with rolled tissue products which may or may not be individually wrapped with the same material or similar wrapping material. All of the products to be bundled have the same diameter and the same longitudinal length. The bundle is sealed by a thermowelding system on the front and the rear of the bundle, and on the top side of the bundle at which location the wrapping material is overlapped. The wrapping material is supplied from a single supply reel and, for larger paper products such as household towel rolls, the rolls are fed and collated in a horizontal position and at no time are upended so as to be traveling vertically through the apparatus.

DESCRIPTION OF THE PREFERRED EMBODIMENTS

Figure 1:
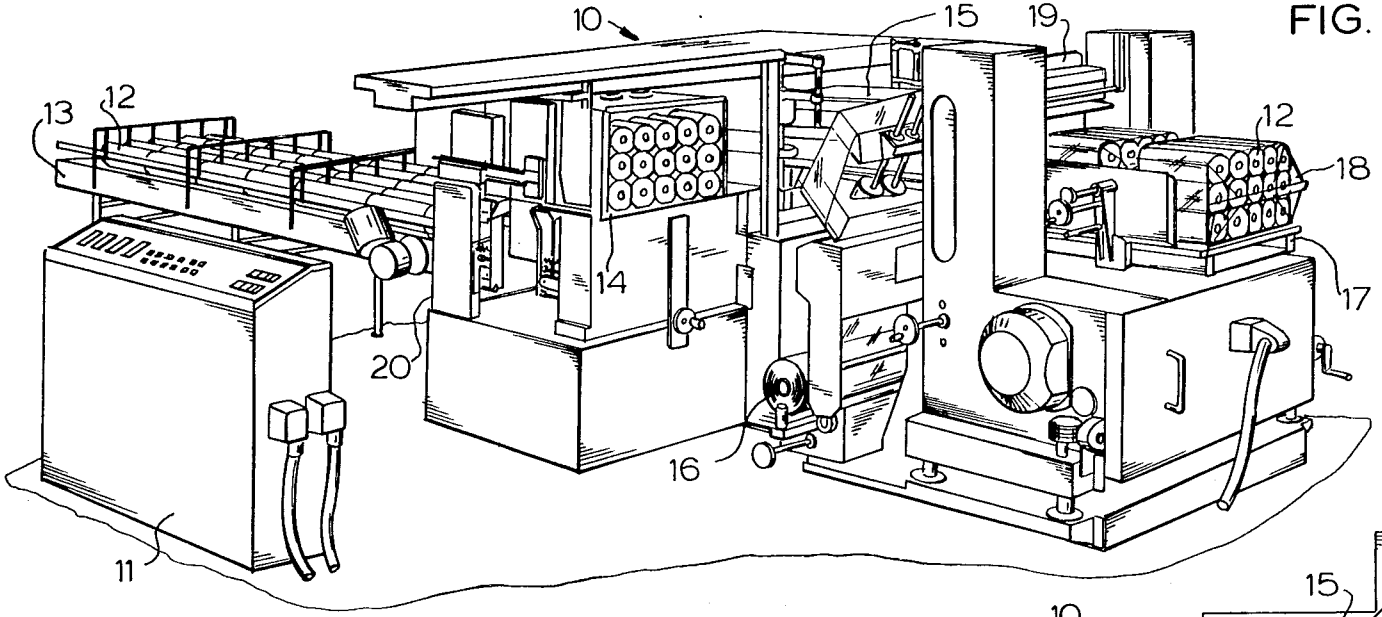
FIG. 1 is a perspective view of an automatic bundling machine constructed in accordance with the principles of the present invention for bundling paper towels.

An automatic bundling machine constructed in accordance with the principles of the present invention is shown at 10 in FIG. 1. The machine basically includes a control panel 11, article feed means 13 for feeding rolled articles 12 for bundling into the machine 10, a loading station 20, a compression station 14, a bundling station 15 for bundling the articles utilizing a single sheet of wrapping material from a supply roll 16, a cutting and sealing station 19, and an exiting station 17 from which wrapped bundles 18 emerge from the machine for further transport.

The articles 12 to be bundled and wrapped may be rolled paper products, such as bathroom tissue rolls or household paper towel rolls. In the embodiment shown in FIG. 1 the article 12 remains horizontal, that is the article 12 is not upended, throughout its entire passage through the machine 10. The articles 12 may be previously individually wrapped with polyethylene or similar wrapping material. The machine 10, as described in greater detail below, may be utilized to wrap bathroom tissue rolls in packages with two, three, four, six, eight, nine, ten, twelve, fifteen, sixteen or twenty rolls, or may be utilized to wrap household paper towels in single, twin or multiple rolls. All of the articles 12 have the same diameter and the same longitudinal length, which may vary according to the previous processing of the rolls. The following explanation and drawings are directed to bundling and wrapping rolls of paper towels.

Figure 2:
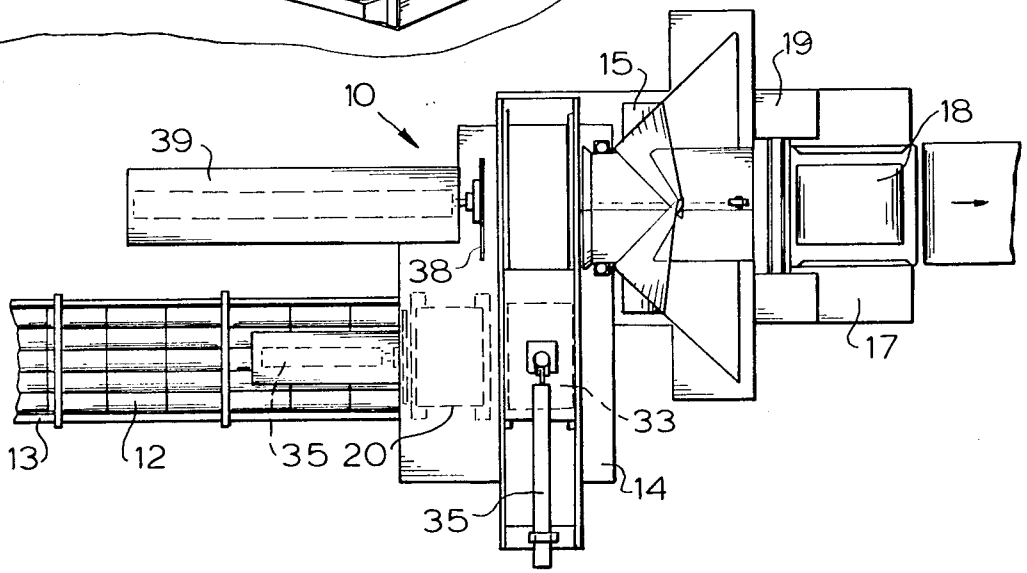
FIG. 2 is a plan view of the machine shown in FIG. 1.
Figure 4:
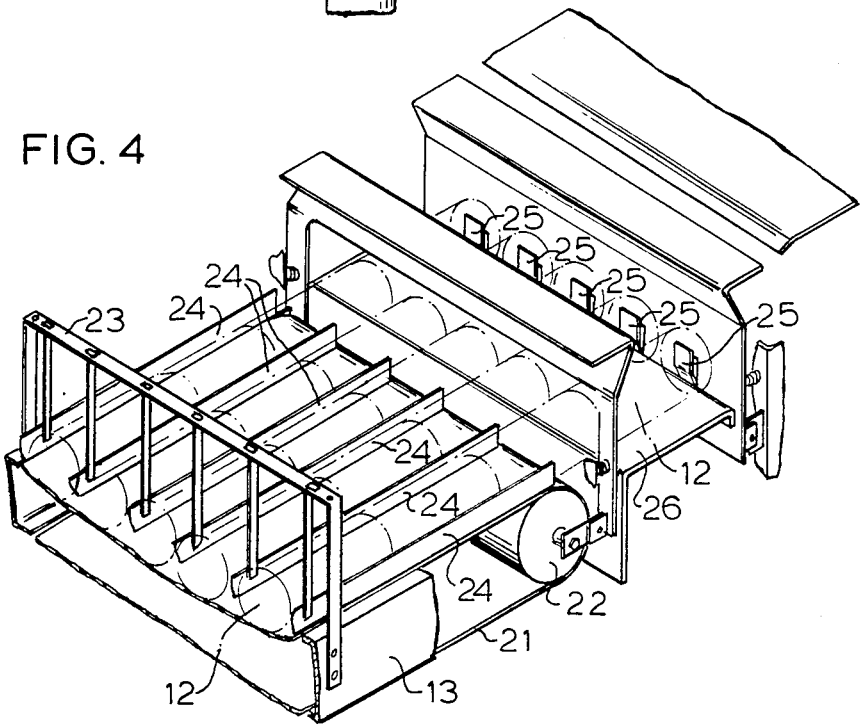
FIG. 4 is a perspective view of a portion of the loading station shown in FIG. 3.

Paper towels are generally bundled in a so-called halfcase (15 rolls) or a full-case (30 rolls). The articles 12, as shown in FIGS. 2 and 4, are therefore conveyed to the bundling machine 10 by a conveyer means 13 in five side by side lanes. The conveyer means 13 maybe of any type known to those skilled in the art, such as an endless belt 21 driven by a drive means (not shown) around a turning roller 22. A gate means 23 aligns the five lanes of articles 12. As stated above, in this embodiment the articles 12 are rolls of paper towels which are disposed with their respective cores horizontal as received from an upstream unit (not shown). The gate means 23 has a plurality of spaced parallel guide bars 24 for separating the articles 12. Within the loading or collating station 20 of the machine 10, each lane of articles 12 has a sensor 25 which is activated by the pressure caused by the presence of an article 12 thereagainst. When all five sensors 25 indicate the presence of an article 12 adjacent thereto, thus signifying a completed row of articles 12 on a platform 26, a mechanically-ddriven elevator 27 is activated which elevates the row of five articles 12. The articles 12 are pushed by the elevator 27 through two spaced resilient supports 28. The upward push of the articles 12 between the resilient spring-loaded supports 28 pushes the supports apart and permits the row of articles 12 to be forced therethrough, after which the row articles 12 rests on a plane defined by flat flanges 29 attached to the resilient supports 28. After the row of 5 articles 12 is pushed between the supports 28 the supports 28 again close so as to prevent the row of articles 12 from falling back through the supports 28. The elevator 27 is then again lowered so as to permit another row of five articles 12 to enter the loading station, and again the elevator 27 elevates that row of articles 12 just as before, this time pushing the previous row of articles 12 upward. This process is again repeated so that three rows of articles 12 (a total of 15 articles) are in the loading station in stacked sequence.

At the end of the third stroke, the elevator 27 stops slightly higher than the platform 29 so as to firmly hold the articles 12 against an adjustable contact plate 30, which is positioned by a manually-adjustable worm 31. The three rows of articles 12 are also firmly held at their sides by vertical side plates (not shown).

Figure 5:
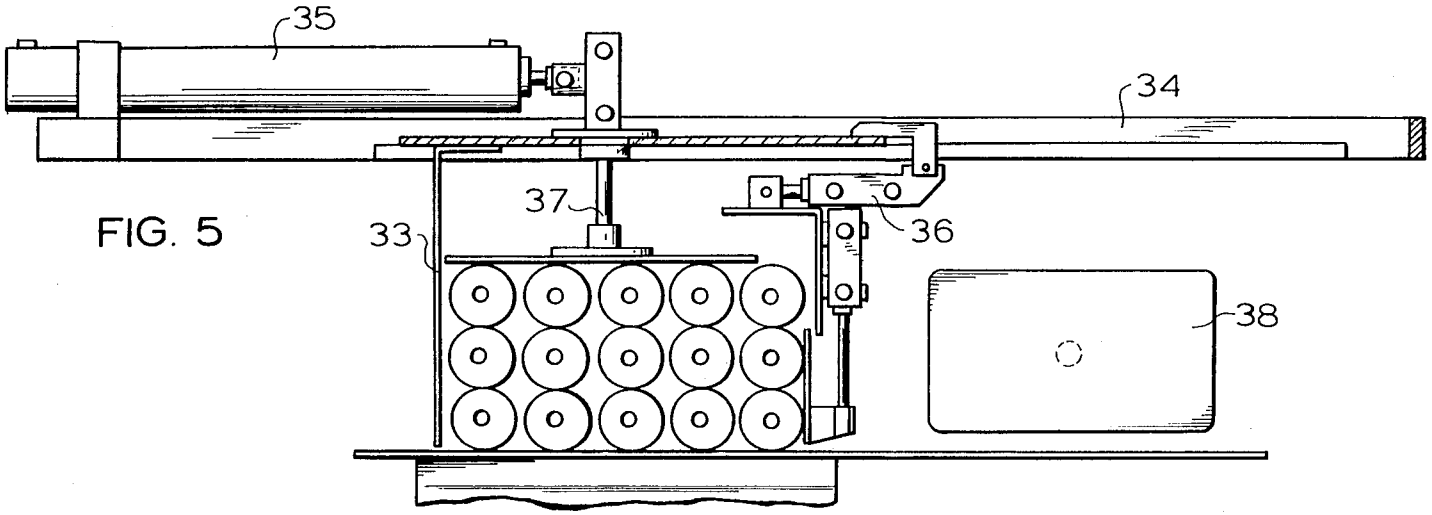
FIG. 5 is an end view of the compression station for the machine shown in FIG. 1 prior to compression of the rolls.
Figure 6:
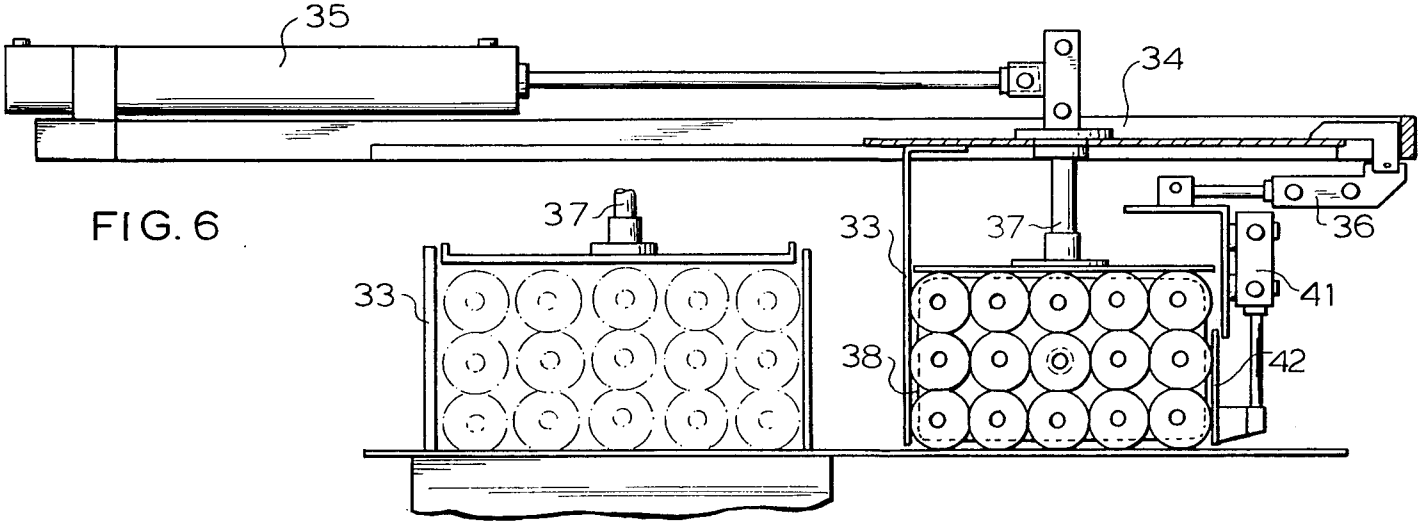
FIG. 6 is an end view of the compression station of the machine shown in FIG. 1 after compression of the rolls.

The stopping of the elevator 27 at its uppermost position commands a pusher 32 to push the articles 12 forward into a transfer unit 33 shown in end view in FIGS. 5 and 6. The transfer unit 33 has a support element 34 along which the transfer unit 33 is moved by a piston 35. When the pusher 32 pushes the articles forward, the articles are in the transfer unit 33 in the position shown in FIG. 5. Upon withdrawal of the pusher 32 the piston 35 is commanded to move the transfer unit 33 from the position shown in FIG. 5 to the position shown in FIG. 6 along the support element 34. When the transfer unit 33 stops in the position in FIG. 6, compression from the side is made by the piston 36 and compression from above is undertaken by another piston 37, the degree of compression being adjustable to suit individual requirements. Thus both the height and width of the stacked rows of articles 12 are reduced, and moreover such height and width compression can be adjustablly undertaken to accommodate various types and sizes of products. Height compression is separately schematically shown in FIG. 6 for comparison purposes, although it will be understood that such height compression is not undertaken exactly in the manner shown in the insert at the lower left of FIG. 6.

When the transfer unit 33 stops at the position shown in FIG. 6, the compressed articles 12 will be precisely positioned in front of a pusher plate 38 of a main ram 39 (shown in FIG. 2). When so positioned, the size of the compressed rows of articles 12 will be precisely that of a tunnel or mandril 40 (shown in FIG. 7). The compressed articles 12 are pushed into and through the entrance of the tunnel mandril 40, which is located in the wrapping or bundling station 15, by the ram 39 for bundling as described in greater detail below. As soon as the ram 39 pushes the compressed articles 12 off of the transfer unit 33, a piston 41 raises a side plate 42. Return of the transfer unit 33 to the position shown in FIG. 5 can be made immediately, while the ram 39 is still inside the mandril 40. Because the elevated position of the side plate 42 will not interfer with the ram 39 during return of the transfer unit 33 the transfer unit 33 can be reloaded with other rows of articles 12 while the bundling is being undertaken. The articles 12 can then again be brought in front of the pusher plate 38 as soon as the plate 38 has returned to its ready position for the next cycle.

Figure 3:
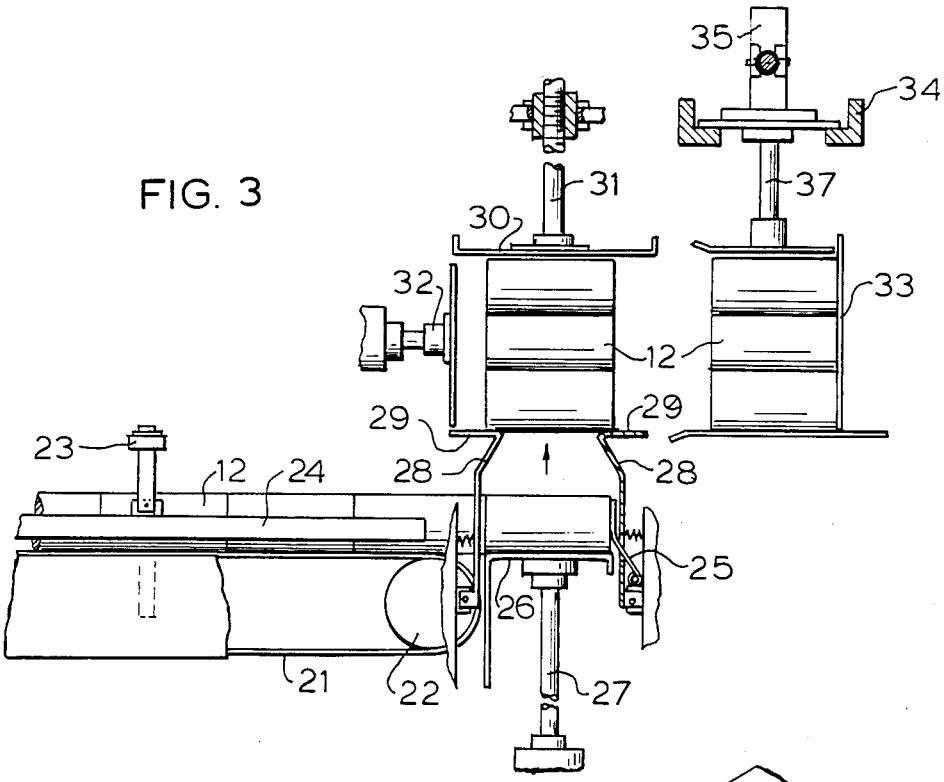
FIG. 3 is a side view of the loading station for the machine shown in FIG. 1.
Figures 7, 8, 11, 17:
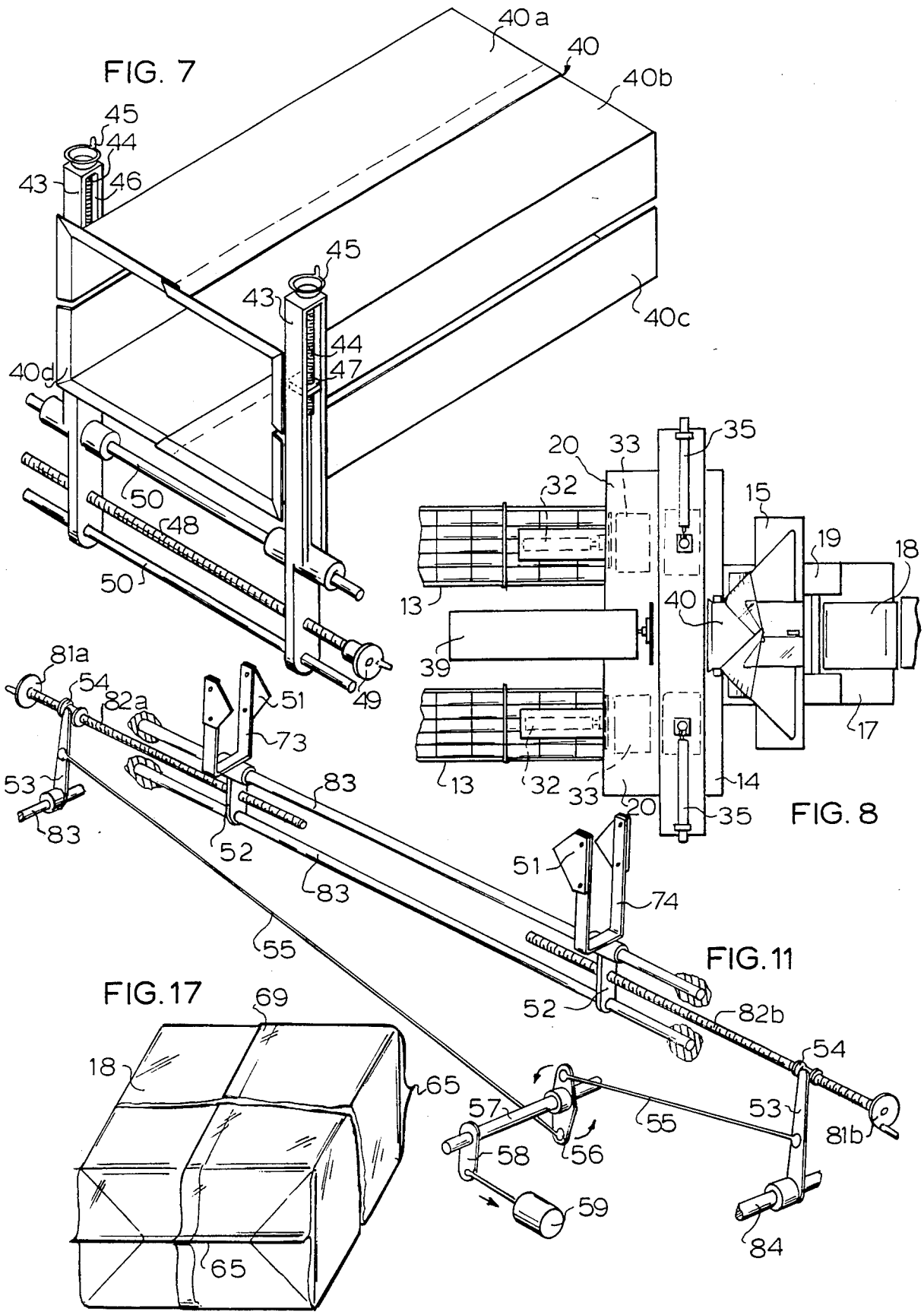
FIG. 7 is a perspective view of a tunnel or mandrel about which the wrapping material is folded for bundling the articles.
FIG. 8 is a plan view of an alternate embodiment of the loading station and wrapping station for the machine embodying two article conveyer feeds.
FIG. 11 is a perspective view of a tuck-folder for effecting the end folds of the bundle as seen in FIG. 17.
FIG. 17 is a perspective view of a wrapped bundle as it appears after bundling and wrapping in the machine shown in FIG. 1.

As shown in FIG. 8, because feed of the articles 12 is always made at one side of the machine, and the articles 12 are transferred perpendicularly with respect to the main ram 39 (and the mandril 40), at which location the bundle is wrapped, the machine 10 may be equipped with two conveyer feed means 13. In this embodiment, the loading stage 20 is equipped with two sets of sensors and two elevator means operating identically as described in connection with FIG. 3 and FIG. 4. The compression stage 14 is provided with two mirror symmetric compression means, each operating as described in connection with FIG. 5 and FIG. 6. This embodiment permits the same machine to handle articles 12 differently wrapped, which may require different feeding and collating dimensions such as, for example, bundles having two bathroom tissue rolls on one side and multiple packs with ten, twelve, fifteen, sixteen, twenty or twenty-four rolls on the other side. One side may then be operated at a time. The operation of the machine 10 remains the same as described below, only the feeding and collating of bundles of different sizes can be accomodated.

The size-adjustable mandril or tunnel 40 is shown in detail in FIG. 7, and horizontal adjustment means therefore are shown in detail in FIG. 7 as well. As shown in FIG. 7, the mandril 40 is comprised of four right angle sections 40*a*, 40*b*, 40*c* and 40*d*. These sections overlap to form a rectangular volume into which the compressed articles 12 are inserted by the ram 39. The section 40*a* and 40*b* are each adjustable as to height with respect ot the lower sections 40*c* and 40*d* by means of vertical adjustable support elements 43. Each support element 43 receives a threaded rod 44 rotatable by a handle 45. Each rod 44 has a threaded slide element 47 respectively connected to the sections 40*a* and 40*b*. As the threaded rod 44 is rotated by the handle 45, the slide 47 moves vertically within a slot 46 in the support element 43, thereby raising and lowering the sections 40*a* and 40*b*.

One of embodiment for adjustment of the size, i.e. the volume, of the mandril 40 is shown in FIG. 7. In this embodiment, each vertical support element 43 has a lower portion respectively receiving two parallel horizontal slide rods 50 and a threaded rod 48 having a handle 49. As the threaded rod 48 is rotated by the handle 49, the support element at the left of FIG. 7 is spread apart from or brought closer to the other support element 43 (which is fixed), depending upon the direction of rotation, by sliding along the rods 50. This movement simultaneously laterally moves the mandril sections 40*a* and 40*d*.

Figure 9:
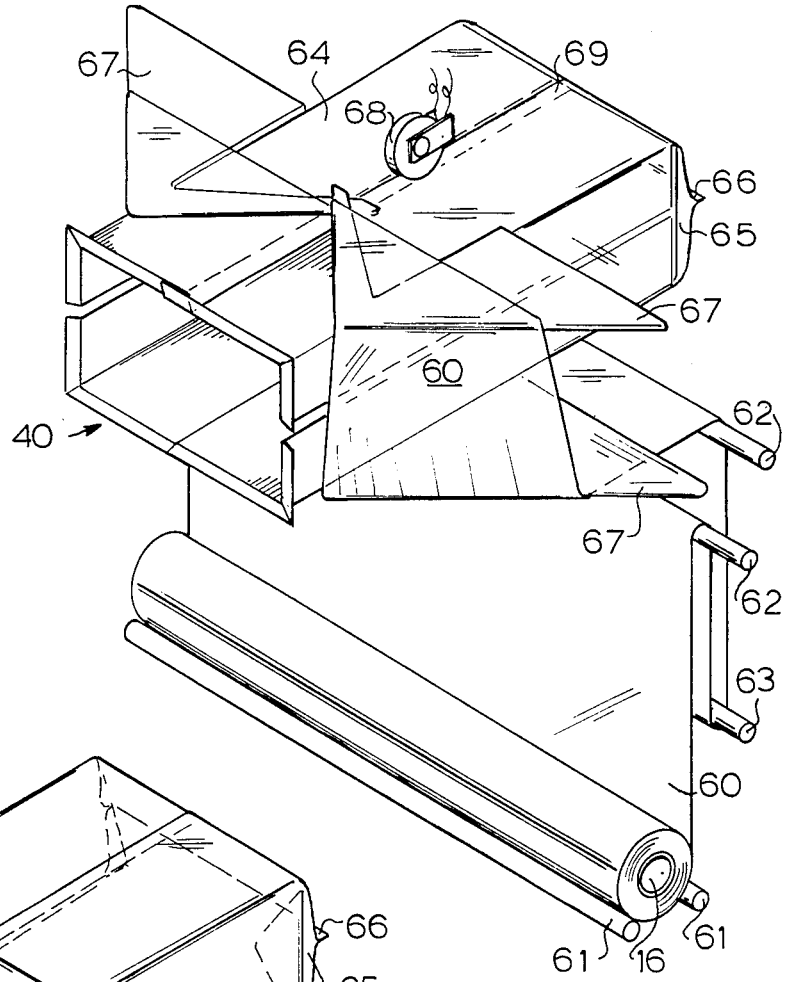
FIG. 9 is a perspective view of the bundling station of the machine showing a first bundling stage.

The supply reel 16 of thermoweldble wrapping material 60 is mounted on and unwound by two motor-driven rollers 61 as shown in FIG. 9. The thermoweldable material 60 may, for example, be polyethylene having a thickness of approximately 2.75 mils (70 microns), and may be as thin as 1.5 mils (38.18 microns).

Figure 12:
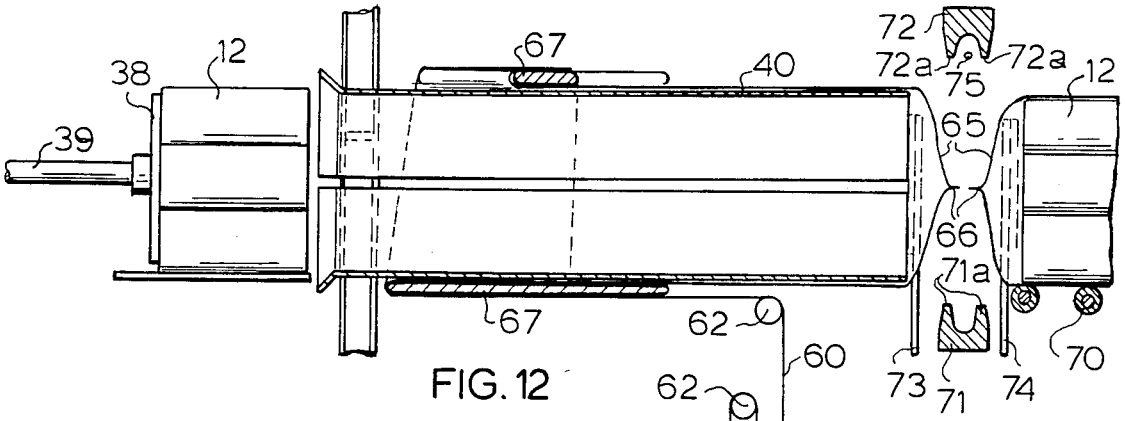
FIG. 12 is a side view of the bundling station and the sealing and cutting station for the machine shown in FIG. 1 during a first stage of operation.
Figure 13:
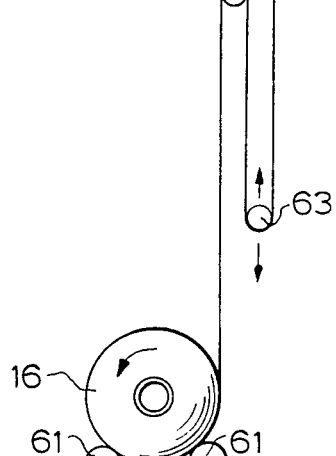
FIG. 13 is a side view of the bundling station and the cutting and sealing station of the machine shown in FIG. 1 in a second stage of operation.
Figure 13:
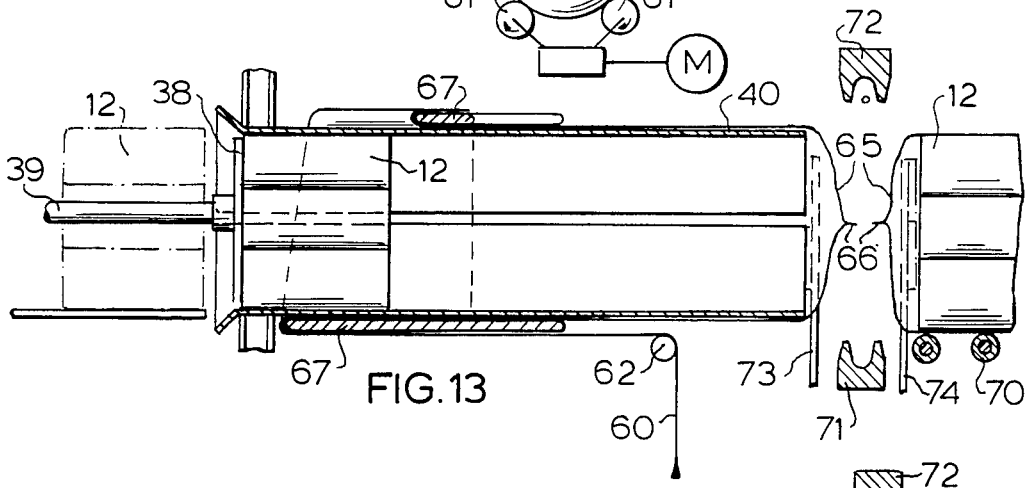
Figure 14:
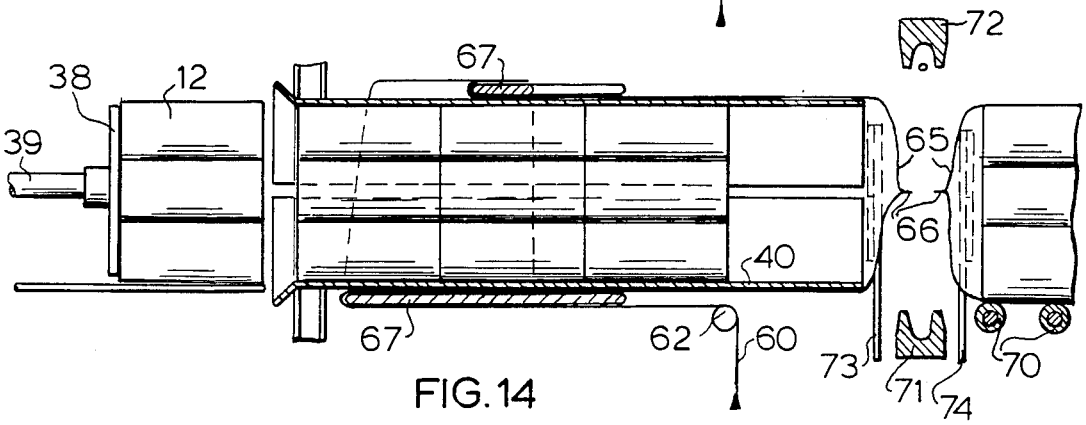
FIG. 14 is a side view of the bundling station and the cutting and sealing station of the machine shown in FIG. 1 during a third stge of operation.

The material 60 is threaded around two fixed rollers 62 and an idler roller 63 therebetween. As a result of a previous wrapping operation, the material 60 surrounding the outside of the mandril 40 is in the form of a partial bundle 64 having one closed end 65 with a weld seam 66 resulting from the previous bundling cycle, described in detail below. The opposite end of the partial bundle 64 is open for receiving the compressed articles 12 pushed by the ram 39. The compressed articles will be pushed through the mandril 40 by the ram 39 until reaching the closed end 65 of the partial bundle 64, thereby pulling the material 60 to advance the material to bundle the articles. The material 60 is cut and sealed between the groups of articles 12 as described in greater detail in connection with FIGS. 15 and 16. A sequence involving several groups of compressed articles 12 may be undertaken as shown in FIGS. 12, 13, and 14 (with a shorter ram stroke) wherein the previously inserted group is pushed further into the mandril 40 by successively following groups, and a seal is effected after a desired number of groups have been entered.

Figure 10:
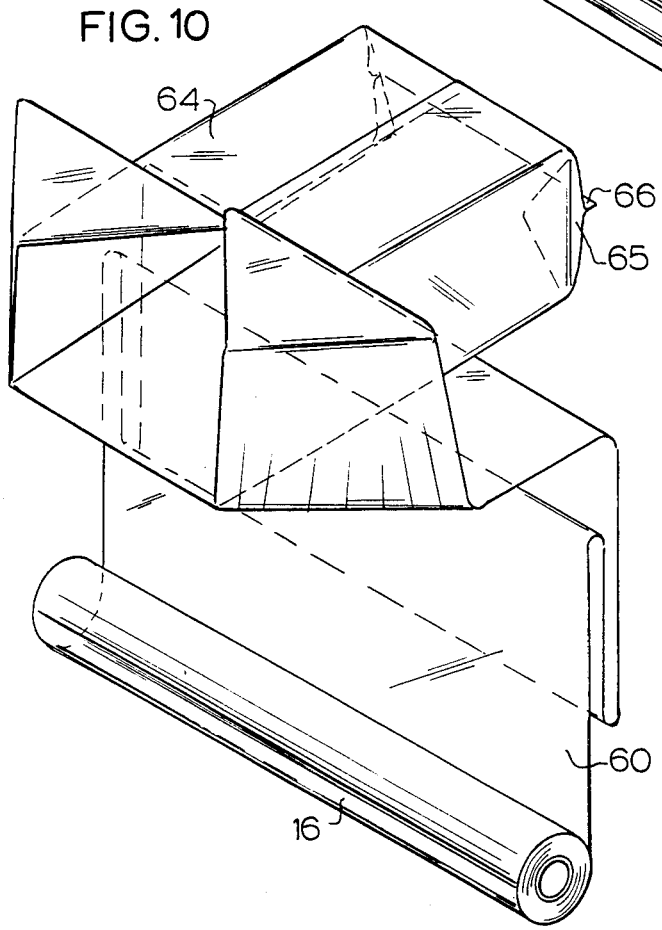
FIG. 10 is a perspective view of the bundling station of the machine showing a second bundling stage.

The partial bundle 64 is formed by folding the material 60 around four wings 67 (three of which can be seen in FIG. 9). Advancement of the material 60 occurs when the idler roller 63 senses the pressure due to articles 12 pushing against the closed end 65, thereby activating a microswitch for in turn activate the drive rollers 61. The drive rollers 61 will permit unwinding of a length of material 60 from the supply reel 16 necessary to wrap the next group of articles 12. Thus only as much material 60 as is needed is unwound at a time. Depending upon the number of articles 12 which are to be bundled together at one time, operation of the ram 39 can be controlled to undertake multiple strokes. For example, if only a half-case is to be bundled, the bundling cycle will consist of only one full stroke of the ram 39 to introduce 15 compressed articles 12 into the mandril 40. If a full-case is to be bundled, the ram 39 will have to make a second stroke to load a second group of 15 articles 12 into the mandril 40. From the second fixed roller 62, the material 60 (still fully opened and flat) goes around the lower wings 67 on both sides of the mandril 40 and under the bottom of the mandril 40. In this manner, the bottom and two sides of the wrapper or bundle are formed by the wings 67. The material 60 then is folded by the upper wings 67 so that the material 60 extends around the rectangular mandril 40 with one side overlapping the other. A top sealing means, such as a heated roller 68 selas the top seam 69 of the partial bundle 64. The initial partial bundle 64 is formed by pulling the material 60 by hand at the beginning of the supply reel 16 after loading the machine. For better visualizing the folding which achieves the partial bundle 64 from a single sheet of material 60 the path of the material 60 is shown in FIG. 10 with no supporting structure therebeneath.

As shown in the sequence in FIGS. 12, 13, 14, 15 and 16, the ram 39 eventually loads enough groups of compressed articles 12 through the mandril 40 so as to push against and advance the closed end 65 of the wrapper material 60. At an appropriate point after the compressed articles have been ejected from the tunnel mandril into the wrapper, heating bars 71 and 72 are commanded to come together to seal the wrapper tube. The bar 71 has spaced projection 71*a* and the bar 72 has spaced projections 72*a* which mate therewith to produce seals 66 for the preceeding and following bundles. The seal 66 for the preceeding bundle completely seals that bundle, and the seal 66 for the following partial bundle generates the closed end 65 against which the next bundle of articles 12 will push. A cutting wire 75 disposed centrally between the projection 72*a* of the bar 72 makes a clean cut between the two bundles. The material 60 for the completely sealed bundle is simultaneously tuck folded by folders 73 and 74, and the material 60 for the preceeding partial bundle is also tuck folded by the folders 73 and 74 for forming the closed end 65. The next activation of the ram 39 advances the completely sealed bundle along rollers 70 for further transport. Return of the ram 39 in the opposite direction simultaneously commands operation of the tuck folders 73 and 74.

As shown in FIG. 11, the tuck folders 73 and 74 are each mounted on support arms 52, each of which slides along spaced parallel horizontal rods 83. The arm 52 supporting the bracket 73 receives a threaded rod 82*a* turnable by a handle 81*a*, and the arm 52 supporting the tuck folder 74 receives a similar threaded rod 82b turnable by a handle 81*b*. The tuck folders 73 and 74 are actuated during a bundling cycle immediately after the sealing bars 71 and 72 move together by the actuation and adjustment mechanism shown in FIG. 11. Each of the threaded rods 82*a* and 82*b* has a spool 54 thereon having a threaded bore. Each spool 54 engages a crank 53 pivotally mounted on an axle 84. The cranks 53 are simultaneously driven by tie rods 55 each connected to a bell crank 56 which is co-rotatably mounted on an axle 57. The axle 57 is actuated by a linkage 58 connected to a cam-driven lever 59 to move the tuck folders 73 and 74 at the appropriate moment in the bundling cycle. The handles 81*a* and 81*b* are utilized to adjust the amount of displacement of the tuck folders 73 and 74 in accordance with the height of the stack or stacks of articles 12 to be bundled, a higher stack requiring a larger tuck fold, and thus a greater displacement of the tuck folders 73 and 74 than does a bundle having a lower height, which can be reliably sealed with relatively small end flaps, thus requiring only a small displacement of the tuck folders 73 and 74.

Figure 15:
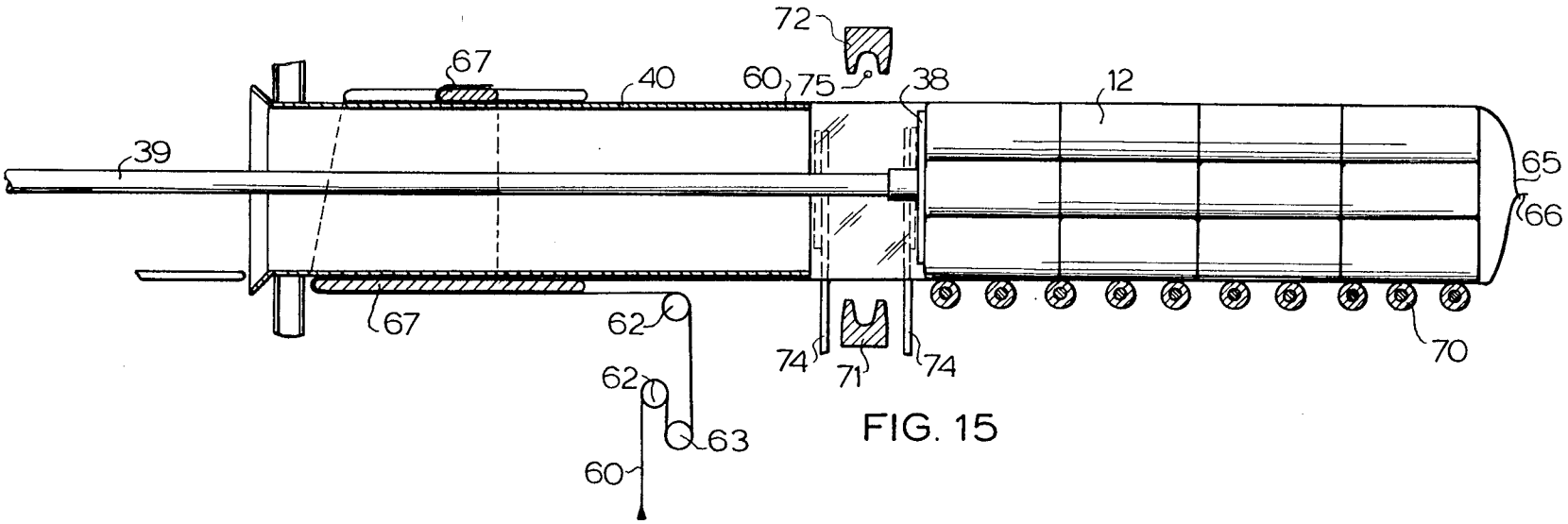
FIG. 15 is a side view of the cutting and sealing station of the machine shown in FIG. 1 during a first stage of operation.
Figure 16:
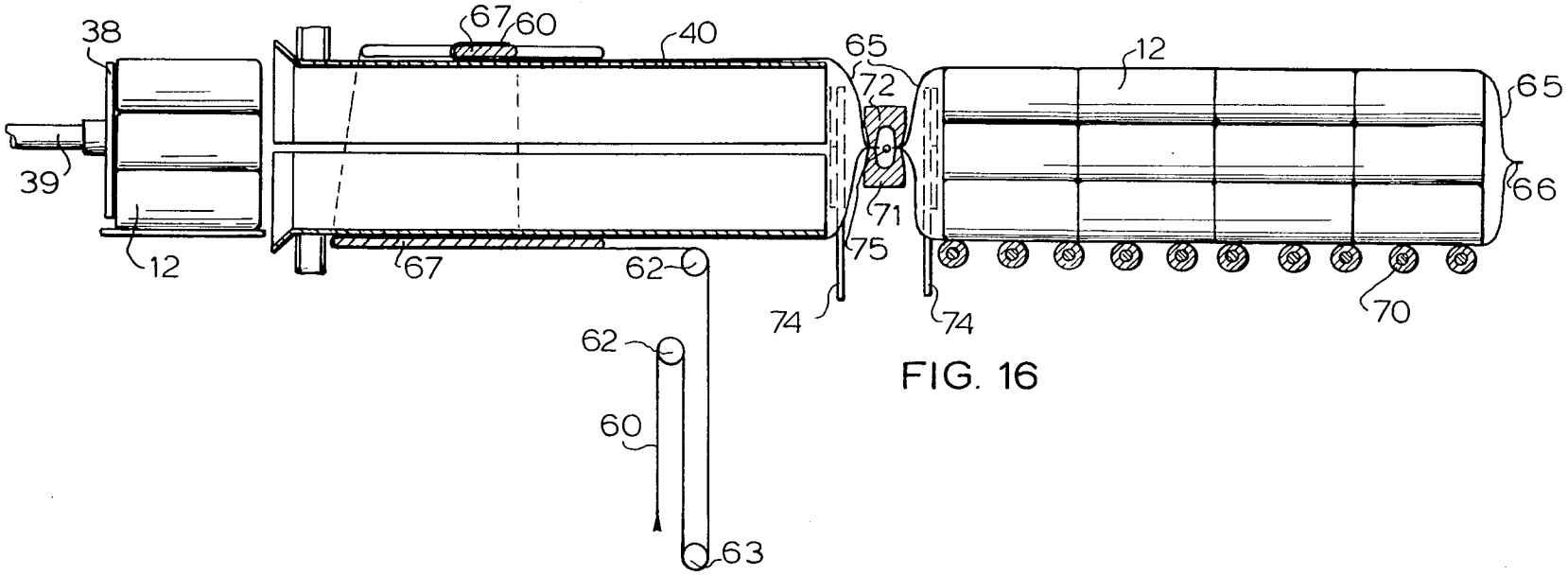
FIG. 16 is a side view of the cutting and sealing station of the machine shown in FIG. 1 in a second stage of operation.

An electrical impulse heats the cutting wire 75 which cuts the material 60 between the two seals 66 while the sealing bars 72 and 71 are still closed. Clamping means acting cooperatively with the sealing bars 71 and 72 are employed (not shown). This sequence is shown in FIGS. 15 and 16. Another command opens the bar 71 and 72 for passage of the next partial bundle.

The top sealing means may, as described above, be a heated roller 68 or may be any suitable sealing means known to those skilled in the art such as a continuous sealer which seals the overlapping material 60 by means of a hot air jet.

As stated above, the bundling machine 10 is ideally suited for bundling larger and/or heavier rolled products, such as household paper towels, because the articles 12 always remain horizontal throughout the entire bundling process, thereby avoiding clogging and friction problems which result when such heavier products are attempted to be moved while in a vertical position. Such a problem is not as acute, however, with smaller articles such as bathroom tissue rolls. The machine 10 may be adapted to accomodate bathroom tissue rolls for bundling in an embodiment shown in FIGS. 18 and 19. The basic operation of the collating, compression (side compression only), and bundling of the articles is the same as described above in this embodiment, however the machine 10*a* for smaller articles 12*a*, such as bathroom tissue rolls, includes an upender 75 which takes the horizontal articles 12*a* from the conveyer means 13 and upends (that is, vertically places) the articles 12a. As shown in FIG. 19, the upender 75 consists of two parallel endless chains 76 trained about two rotating drive gears 77 and having a plurality of brackets 78 thereon. As the gears 77 rotate in the direction of the arrows, each bracket 78 catches a selected number of smaller articles 12*a* such that those articles are placed vertically as the brackets 78 continue there movement. In the embodiment shown in FIGS. 18 and 19, the smaller articles 12*a* are arranged in three side-by-side lanes and the upender 75 catches two such rows of articles 12*a* at a time. It will be understood that the brackets 78 may be selected in size to upend a larger number of rows if desired.

Figure 18:
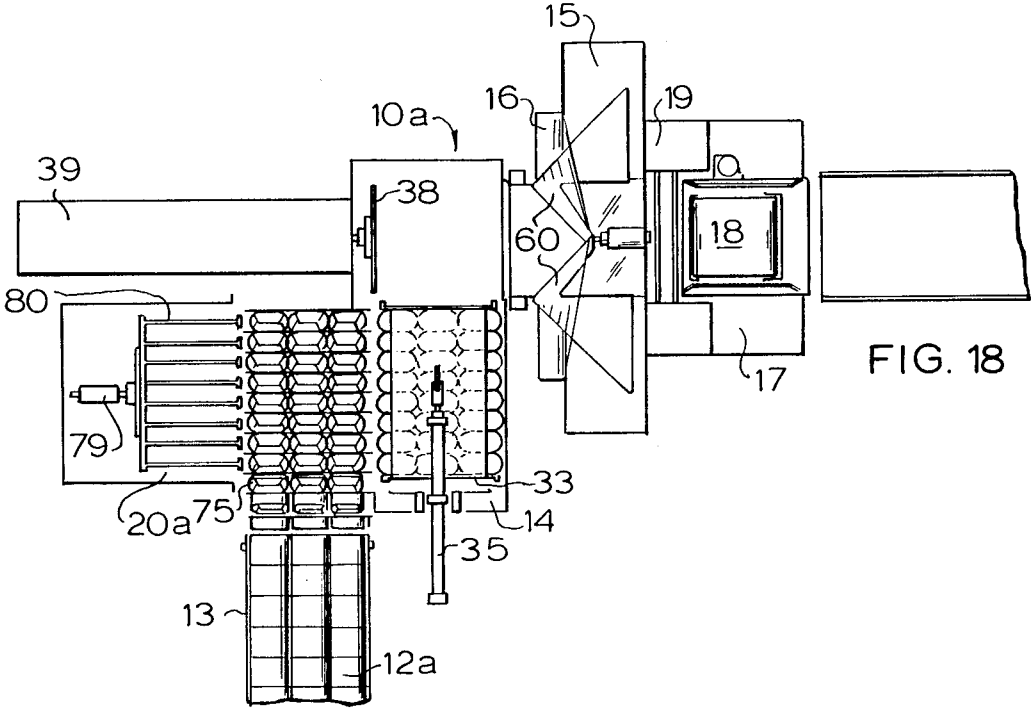
FIG. 18 is a plan view of an embodiment of the machine shown in FIG. 1 for wrapping bathroom tissue rolls.
Figure 19:
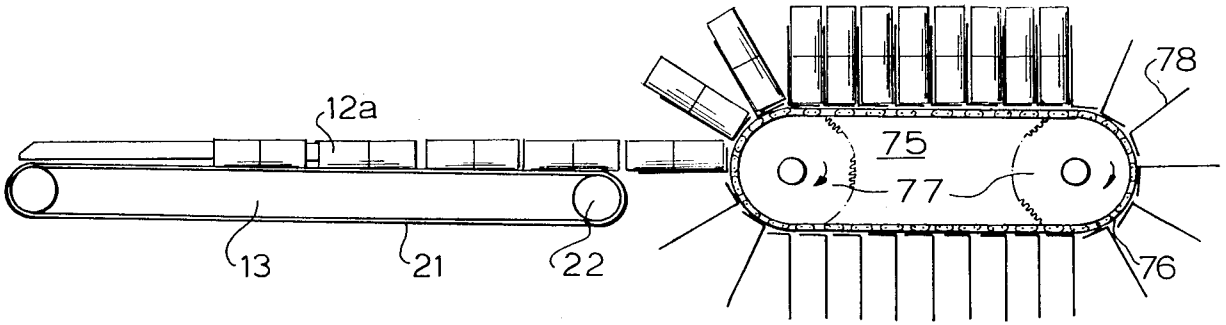
FIG. 19 is a side view of an upender for use in the embodiment of the machine shown in FIG. 18.

As shown in FIG. 18, the loading station 20*a* of the machine 10*a* is modified in comparison to the loading station 20 for larger articles described above. In this embodiment, the loading station 20*a* has a mechanically-driven arm 79 for moving a plurality of spaced parallel pushers 80 for loading the smaller articles 12*a* into the collating and compression station 14. The operation of the arm 79 to eject the smaller articles 12*a* into the collating and compression station 14 may be timed in coordinaton with the speed of the upender chains 76 to actuate the arm 79 when a desired number of full rows are present in front of the pushers 80. Any suitable sensing means such as a photocell well known to those skilled in the art may be employed to actuate the arm 79 after any desired number of full rows is present, which may be varied simply be placement of the sensing means.

Although modifications and changes may be suggested by those skilled in the art it is the intention of the inventor to embody within the patent warranted hereon all changes and modifications as reasonably and properly come within the scope of his contribution to the art.

I claim as my invention:

1. An automatic bundling apparatus for bundling selected number of articles in bundles with sheet material for use in combination with a conveyer means for feeding horizontally disposed rows of articles to said apparatus, said apparatus comprising:

a wrapping stage having a sheet material supply reel, a hollow mandril having an entrance at one end and an exit at the opposite end, and a means for folding said sheet material around the outside of said mandril for forming a tubular first wrapper having one open end generally aligned with said entrance and one sealed end adjacently beyond said exit;

a main ram disposed in front of said entrance of said mandril and adjacent said open end of said wrapper;

a collating stage for receiving a selected plurality of stacked rows of said articles from said conveyer means;

a compressing stage for receiving said articles from said collating stage, said compressing stage having means for, in sequence, transporting said stack of rows to a position between said main ram and said mandril entrance and for simultaneously compressing the height and the width of said stack of rows;

a control means for actuating said ram for pushing said stack of rows through said entrance and the inside of said mandril such that said stack of rows advances through said mandril and out of said exit and pushes against said sealed end of said wrapper and moves on beyond said exit and advances said wrapper off of said mandril and simultaneously advances a discrete amount of sheet material from said supply reel around the outside of said mandril for forming a next wrapper for a next stack of rows; and a cutting and sealing stage disposed adjacently beyond said exit for receiving thereby said first wrapper with said stacks of rows in said first wrapper from said wrapping stage, said cutting and sealing stage having means for simultaneously sealing the open end of said first wrapper, between said exit and the trailing end of the advanced stack of rows in said first wrapper, and forming the sealed end of said next wrapper, and separating said first wrapper from said next wrapper.

2. An apparatus as claimed in claim 1 further comprising a transport unit in said compressing stage for receiving said stacked rows of articles for transport to said position between said main ram and said mandril.

3. An apparatus as claimed in claim 1 wherein said compressing stage comprises:

a first pressure-applying means positioned for applying vertical pressure to said stack of rows for compressing the height thereof; and a second pressure-applying means for simultaneously applying horizontal pressure to said stack of rows for compressing the width thereof.

4. An apparatus as claimed in claim 2 wherein said first and second pressure applying means are pneumatic pistons.

5. An apparatus as claimed in claim 2 wherein said transport unit has at least one vertical side and wherein said transport unit receives said stacked rows of articles at a first position in said collating stage, and wherein said compressing stage further comprises a means for lifting said side wall of said transport unit after said transport unit is positioned between said main ram and said mandril for enabling said transport unit to return to said first position while said main ram is actuated.

6. An apparatus as claimed in claim 5 wherein said means for lifting said side wall of said transport unit is a pneumatically operated lever attached to said side wall.

7. An apparatus as claimed in claim 1 wherein said conveyer means is disposed at a different horizontal level than said collating stage, and wherein said apparatus further comprises a loading stage having an elevator means for lifting rows of said articles from the level of said conveyer means to the level of said collating stage.

8. An apparatus as claimed in claim 7 wherein said loading stage has a sensor means for detecting the presence of a complete row of said articles in said loading stage, said sensor means supplying a signal to said control means for enabling actuation of said elevator means.

9. An apparatus as claimed in claim 7 wherein said loading stage has a pair of spaced resilient brackets having a spacing therebetween which is less than the size of said articles, said brackets being positioned in said loading stage such that said elevator means forces said row of articles through said brackets after which said brackets support said row of articles on top thereof.

10. An apparatus as claimed in claim 9 wherein said top of said brackets is disposed at the same level as said level of said compressing stage, and wherein said loading stage further comprises a means for horizontally transporting said stacked rows of articles from said top of said brackets in said loading stage to said compressing stage.

11. An apparatus as claimed in claim 10 wherein said means for transporting said rows of articles in a mechanical piston.

12. An apparatus as claimed in claim 1 further comprising an upending means disposed between said collating stage and said conveyer means for changing the orientation of said rows of articles from a horizontal position to a vertical position.

13. An apparatus as claimed in claim 12 wherein said upending means comprises an endless chain means and trained about a pair of spaced drive gears, said endless chain means having a plurality of brackets thereon for receiving at least one row of articles from said conveyer, said row of articles in said bracket being upended as said bracket is moved by said chain means around said drive gears.

14. Apparatus according to claim 1, which comprises means for adjusting the volume of said mandril for accommodating different sizes of stacks of rows of articles.

15. A method for wrapping selected number of articles in bundles with sheet material comprising the steps of:

conveying said articles in horizontally disposed rows;

stacking a selected plurality of said rows on one another;

transporting the stacked rows of articles to a position aligned with one end of a mandril defining a tunnel;

simultaneously compressing the height and width of said stacked rows of articles;

pushing the compressed stacked rows of articles into said one end of said mandril and through said tunnel and then out of the opposite end of said tunnel;

providing a tubular wrapper of sheet material about the outside of said mandril;

enclosing said compressed stacked rows of articles, after leaving said opposite end, in said wrapper of said sheet material feeding additional sheet material about said mandril for providing a succeeding wrapper for receiving succeeding stacked compressed rows of articles; and sealing opposite ends of said sheet material wrapper enclosing said first mentioned compressed stacked rows of articles for forming a wrapped bundle, and in said sealing separating said wrapped bundle from a sealed end of said succeeding wrapper.

16. A method as claimed in claim 15 comprising the additional step of upending said rows of articles before compressing said rows of articles.

17. A method as claimed in claim 15 wherein the step of stacking said rows of articles is further defined by the steps of:

positioning a row of said articles beneath a pair of spaced resilient brackets, said brackets having a normal distance therebetween which is smaller than the size of said articles;

forcing said row of articles through said spaced brackets;

resting said row of articles forced through said spaced brackets on said brackets; and repeating said positioning, forcing and resting steps a selected plurality of times for stacking a like selected plurality of rows.

18. A method according to claim 15, which comprises selectively adjusting the volume of said mandril for receiving different sizes of stacked compressible rolls of articles.

* * * * *